US009329557B2

(12) United States Patent
Kitagawa et al.

(10) Patent No.: US 9,329,557 B2
(45) **Date of Patent: *May 3, 2016**

(54) IMAGE FORMING APPARATUS

(71) Applicant: CANON KABUSHIKI KAISHA, Tokyo (JP)

(72) Inventors: Oki Kitagawa, Kashiwa (JP); Shigeaki Takada, Abiko (JP); Akiyoshi Shinagawa, Kashiwa (JP); Masanobu Tanaka, Tokyo (JP); Hiroki Kawai, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/620,419

(22) Filed: Feb. 12, 2015

(65) Prior Publication Data

US 2015/0212473 A1 Jul. 30, 2015

Related U.S. Application Data

(63) Continuation of application No. 13/677,826, filed on Nov. 15, 2012, now Pat. No. 8,989,640.

(30) Foreign Application Priority Data

Nov. 18, 2011 (JP) ..... 2011-252785

(51) Int. Cl.
*G03G 15/20* (2006.01)
*G03G 15/00* (2006.01)

(52) U.S. Cl.
CPC ..... *G03G 15/70* (2013.01); *G03G 15/20* (2013.01); *G03G 15/2014* (2013.01); *G03G 15/2025* (2013.01)

(58) Field of Classification Search
CPC G03G 15/20; G03G 15/2025; G03G 15/2014
USPC ..... 399/320, 122
See application file for complete search history.

(56) References Cited

U.S. PATENT DOCUMENTS 5,678,134 A 10/1997 Miki et al.
7,200,354 B2 4/2007 Nakamoto et al.

(Continued)

FOREIGN PATENT DOCUMENTS

JP 9-34327 A 2/1997
JP 2008-040365 A 2/2008

(Continued)

*Primary Examiner* — Nguyen Ha
(74) *Attorney, Agent, or Firm* — Fitpatrick, Cella, Harper & Scinto

(57) ABSTRACT

An image heating apparatus includes a heating roller; a nip forming member for forming the nip with the roller; a sheet jam sensor; a first controller for interrupting a heating operation when the sensor detects the sheet jamming, and for resuming the heating operation after the jamming is cleared; a rubbing member for rubbing a heating roller surface; a moving mechanism for moving the rubbing member to a position for spacing the rubbing member from the roller to a position for rubbing the roller surface; and a second controller for executing an operation of moving the rubbing member to the rubbing position to rub the heating roller surface when a predetermined condition is reached, wherein the second controller delays, when the condition is reached during a period in which a predetermined count of sheets pass the nip after the jam clearance, the moving operation to after the period.

7 Claims, 7 Drawing Sheets

(56) References Cited

U.S. PATENT DOCUMENTS

| | | | | |
|---|---|---|---|---|
| 7,457,576 | B2 | 11/2008 | Takada et al. | |
| 7,466,950 | B2 | 12/2008 | Matsuura et al. | |
| 7,596,348 | B2 | 9/2009 | Nakamoto et al. | |
| 7,650,105 | B2 | 1/2010 | Ogawa et al. | |
| 7,844,208 | B2 | 11/2010 | Hayashi et al. | |
| 8,208,833 | B2 | 6/2012 | Kitagawa | |
| 8,301,067 | B2 | 10/2012 | Takada | |
| 8,364,067 | B2 | 1/2013 | Miki et al. | |
| 8,447,211 | B2 * | 5/2013 | Takahashi | G03G 15/2025 399/122 |
| 8,989,640 | B2 * | 3/2015 | Kitagawa | G03G 15/2025 399/320 |
| 2008/0038027 | A1 * | 2/2008 | Ito | G03G 15/2025 399/328 |
| 2011/0129253 | A1 | 6/2011 | Takahashi et al. | |
| 2011/0129266 | A1 | 6/2011 | Maruko et al. | |
| 2011/0236082 | A1 | 9/2011 | Kobayashi et al. | |
| 2011/0236084 | A1 | 9/2011 | Nishida et al. | |
| 2011/0305474 | A1 | 12/2011 | Tanaka et al. | |
| 2012/0003346 | A1 | 1/2012 | Chigono et al. | |
| 2012/0027444 | A1 | 2/2012 | Kitagawa | |
| 2012/0099882 | A1 | 4/2012 | Tanaka | |
| 2012/0155938 | A1 | 6/2012 | Tanaka et al. | |
| 2012/0155940 | A1 | 6/2012 | Hagiwara et al. | |
| 2012/0251153 | A1 | 10/2012 | Takada | |
| 2012/0308279 | A1 | 12/2012 | Tanaka et al. | |
| 2013/0034361 | A1 | 2/2013 | Shinagawa | |
| 2013/0034362 | A1 | 2/2013 | Matsuura et al. | |
| 2013/0058672 | A1 | 3/2013 | Takada et al. | |
| 2013/0206745 | A1 | 8/2013 | Tanaka et al. | |

FOREIGN PATENT DOCUMENTS

| | | | |
|---|---|---|---|
| JP | 200840053 | A | 2/2008 |
| JP | 2008268524 | A | 11/2008 |
| JP | 2008268606 | A | 11/2008 |
| JP | 2009237250 | A | 10/2009 |
| JP | 2011175066 | A | 9/2011 |
| JP | 2011175067 | A | 9/2011 |
| JP | 2011-221067 | A | 11/2011 |
| JP | 2011227163 | A | 11/2011 |

* cited by examiner

IMAGE FORMING APPARATUS

CROSS-REFERENCE TO RELATED APPLICATION

This application is a Continuation of U.S. application Ser. No. 13/677,826, filed Nov. 15, 2012, and allowed on Nov. 12, 2014, and which claims priority from Japanese Patent Application No. 2011-252785 filed Nov. 18, 2011, which are both incorporated herein in their entireties by reference.

FIELD OF THE INVENTION AND RELATED ART

The present invention relates to an image heating apparatus (device) which has a rubbing member to be placed in contact with the heating member of the image heating apparatus to minimize the effect of the edge burrs of a sheet of recording medium upon the level of quality at which a fixed toner image is outputted by the image heating apparatus. It also relates to an image forming apparatus which employs an image heating device such as the one described above.

An image heating apparatus (device) having an image heating member (heating belt or roller) and a nip forming means (belt or roller) for forming a nip in cooperation with the heating member is employed by an image forming apparatus to heat a toner image on a sheet of recording medium.

However, edges of some sheets of recording medium have microscopic "burrs", which are microscopic projections resulting along the edges of a sheet of recording medium when a large sheet of recording medium (paper) is cut into smaller sheets of recording medium. Thus, it is possible that as a sheet of recording medium having edge burrs is conveyed through a nip, microscopic scars are made on the surface of the heating member by the edge burrs of the sheet. In terms of the direction perpendicular to the direction in which a sheet of recording medium is conveyed, the points of contact between the lateral edges of a sheet of recording medium of a given size and the heating member remain the same. Therefore, it is possible that the portions of the heating surface of the heating member, which coincide with the points of contact between the lateral edges of the sheet and the heating member, will be microscopically scarred by the edge burrs. With the heating surface of the heating member being scarred, it is possible that an image forming apparatus employing the heating apparatus (device) will output a print, the portions of which corresponding to the scarred portions of the heating surface of the heating member, are different in gloss from the rest of the print.

Thus, there have been proposed various measures for dealing with the microscopic scars made on the image heating surface of a heating member by the edge burrs of a sheet of recording medium. One of the measures is disclosed in Japanese Laid-open Patent Application 2008-40365. According to this patent application, the entirety of the heating surface of a heating member (51) is rubbed by a rubbing member (55) in order to render inconspicuous the scars (scratches) concentrated on the two points of the heating member (55) in terms of the direction perpendicular to the recording medium conveyance. Further, when the rubbing member is not required to rub the heating member, it is kept separated from the heating member in order to prevent the rubbing surface of the rubbing member from being contaminated by the heating member. That is, it is only for every preset number of sheets of recording medium that the rubbing member (55) is placed in contact with the heating member during an image forming operation, in order to rub the heating surface of the heating member.

By the way, it occurs sometimes that when a sheet of recording medium which is stuck in a fixing device (having jammed fixing device) is pulled out of the fixing device, the toner on the sheet adheres to the heating member. Normally, however, the amount by which the toner on the sheet adheres to the heating member is very small. Therefore, it is improbable that the toner having transferred from the sheet onto the heating member affects an image forming apparatus in terms of the level of image quality at which the apparatus output a print.

However, if the timing with which the rubbing member is placed in contact with the heating member comes up, that is, the point in time at which the last of the preset number of sheets of recording medium is conveyed through the fixing device, comes immediately after the sheet of recording medium having jammed the fixing device is removed, it is possible that the following problem will occur.

That is, in the above described case, the toner on the heating member transfers onto the rubbing member, making it possible that some of the numerous microscopic recesses in the surface of the rubbing member will be filled up with the toner. If some of the microscopic recesses in the surface of the rubbing member are filled up with the toner, it becomes difficult for the rubbing member to uniformly rub the heating surface of the heating member.

SUMMARY OF THE INVENTION

Thus, the primary object of the present invention is provide a means for dealing with the problem that the image heating surface of an image heating member is scarred by the burrs which the lateral edges of a sheet of recording medium have. More specifically, it is to prevent the problem that the microscopic recesses in the rubbing surface of the rubbing member are filled with the toner because an image forming apparatus is restarted for image formation immediately after a sheet of recording medium having jammed the fixing device of an image forming apparatus is removed.

According to an aspect of the present invention, there is provided an image heating apparatus comprising a heating rotatable member for heating a toner image on the recording material by a nip; a nip forming member for cooperating with said heating rotatable member to form the nip; a sensor for detecting jamming of the recording material in the nip; a first controller for interrupting an image heating operation of said heating rotatable member when said sensor detects the jamming of the recording material, and for resuming the image heating operation after the jamming is cleared; a rubbing member for rubbing a surface of said heating rotatable member; a moving mechanism for moving said rubbing member a position for spacing said rubbing member from said heating rotatable member to a position for rubbing the surface of said heating rotatable member; and a second controller for executing an operation of moving said rubbing member to the rubbing position to rub the surface of said heating rotatable member when a predetermined condition is reached, wherein said second controller delays, when the predetermined condition is reached during a period in which a predetermined count of recording materials pass the nip after the jam clearance, the moving operation to after the period.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the embodiments of the present invention are described with reference to the appended drawings. The present invention can be embodied in the forms different from those in which the present invention are in the following embodiments of the present invention, even if a part or parts of the structural components of the fixing device are different from those in the following embodiments, as long as the fixing devices in the embodiments other than the following embodiments are structured so that as a sheet of recording medium jams a fixing device, the timing with which the heating member is to be rubbed by the rubbing member is delayed.

In other words, the present invention is applicable to any image forming apparatus, the heating member and pressing member of the fixing device of which are in the form of a belt and/or a roller, as long as the image forming apparatus is structured so that the rubbing member of its fixing device is placed in contact with, or separated from, its heating member. Further, the present invention is applicable to any image forming apparatus, regardless of the method employed by the apparatus to heat its heating member. For example, the present invention is applicable to a fixing device (image forming apparatus), the method employed by which to heat its heating member is a heating lamp, an inductive heating device, a heat generating resistor, an infrared heater, a heat pipe, or the like. Further, the present invention is applicable any image forming apparatus regardless of its charging method, exposing method, and developing method. Further, the present invention is applicable to any electrophotographic image forming apparatus regardless of whether the image forming apparatus is of the tandem type or single drum type, and/or whether the image forming apparatus is of the intermediary transfer type or direct transfer type. In the following description of the embodiments of the present invention, only the primary sections, that is, the toner image forming sections and toner image transferring section, of the image forming apparatus are described. However, the present invention is compatible with various image forming apparatuses, for example, a printer, various printing machines, copying machines, facsimile machines, multifunction machines, etc., which are the combination of the image forming section and image transferring section in the following embodiments of the present invention, and additional devices, equipments, external case, etc.

<Image Forming Apparatus>

Figure 1:
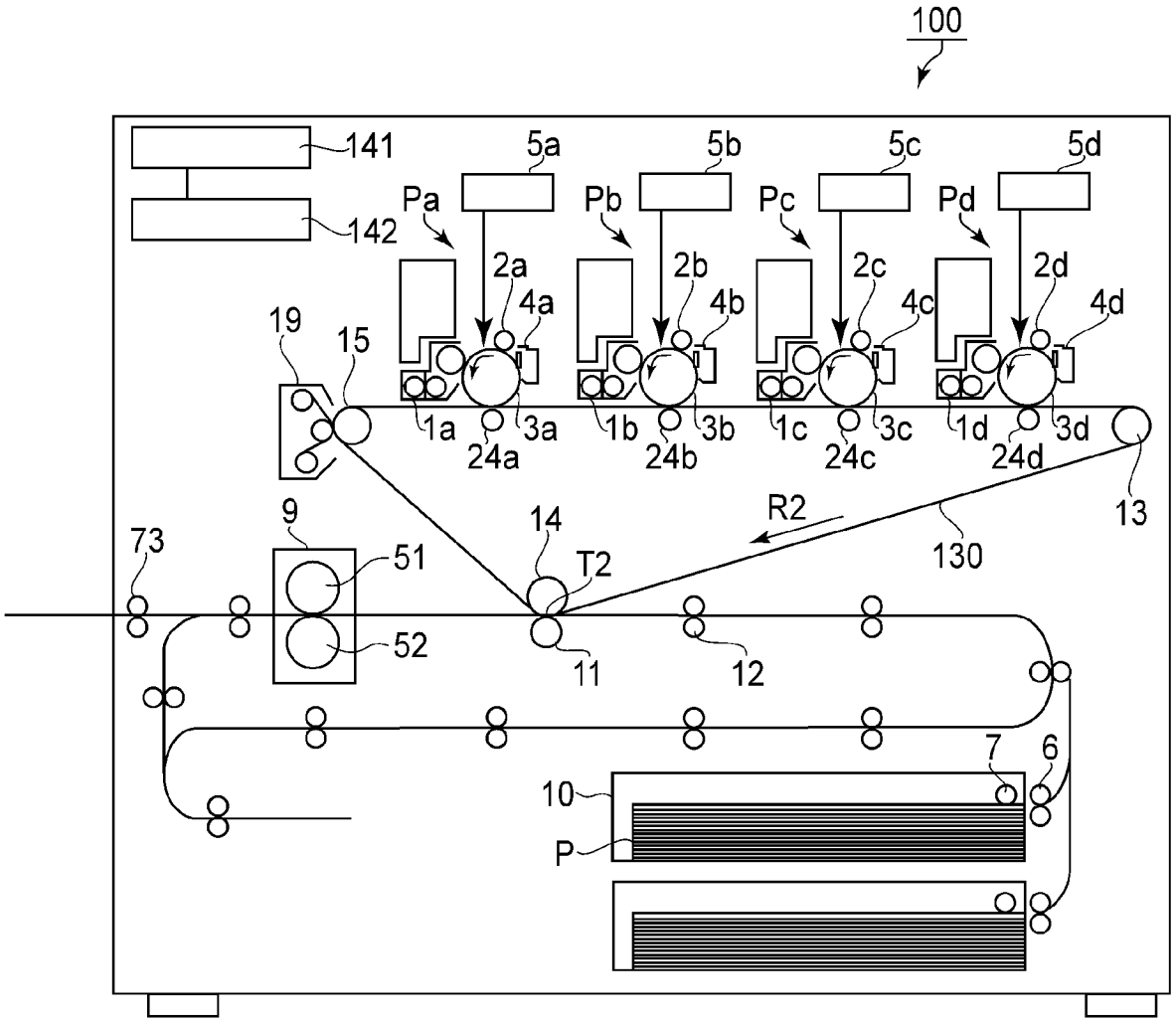
FIG. 1 is a schematic sectional view of a typical electrophotographic image forming apparatus to which the present invention is applicable. It shows the general structure of the apparatus.
Figure 2:
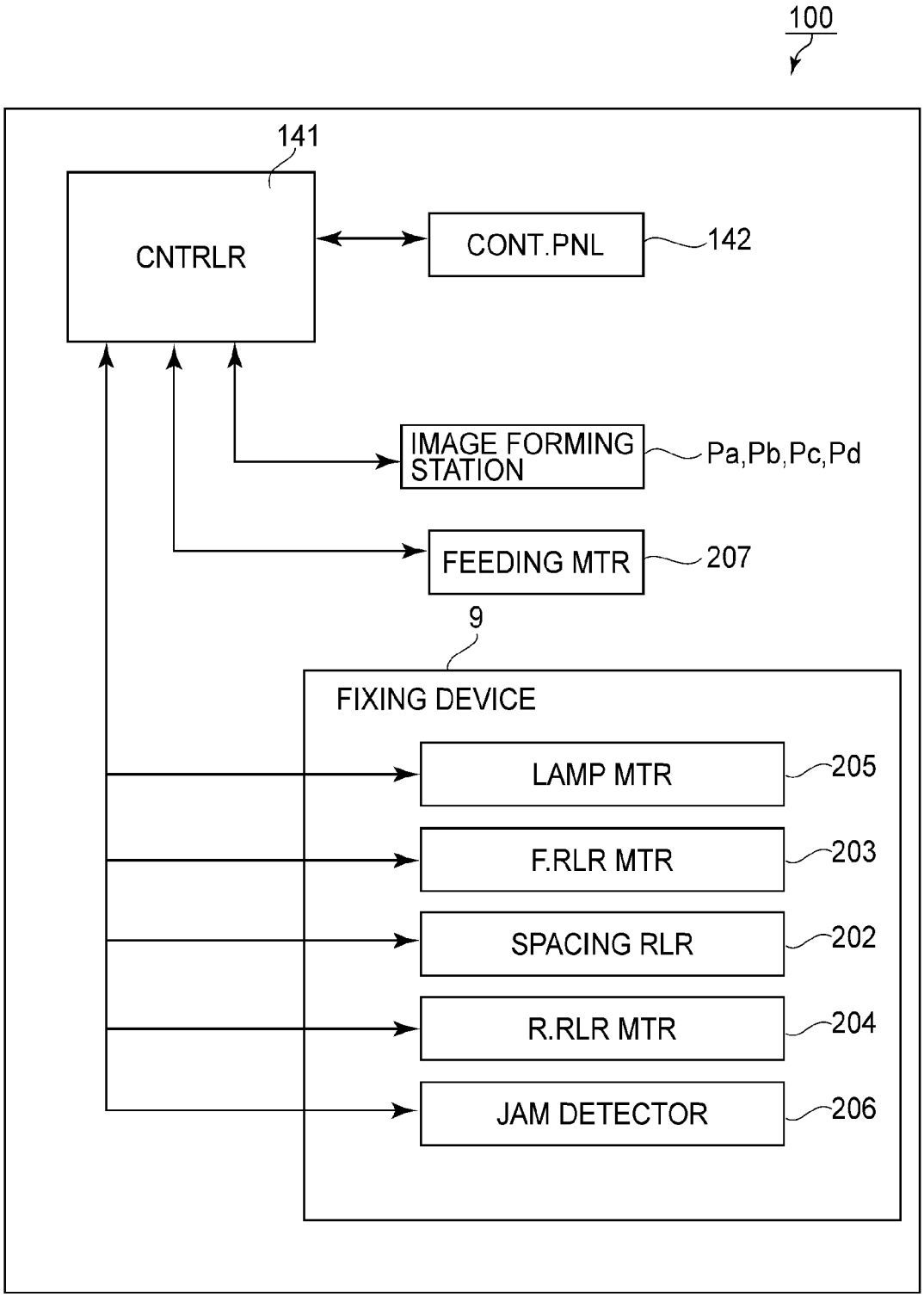
FIG. 2 is a block diagram of the control system of the image forming apparatus shown in FIG. 1.

FIG. 1 is a schematic sectional view of a typical electrophotographic image forming apparatus to which the present invention is applicable. It shows the general structure of the apparatus. FIG. 2 is a block diagram of the control system of the image forming apparatus shown in FIG. 1.

Referring to FIG. 1, the image forming apparatus 100 is a full color printer of the tandem type, and also, of the intermediary transfer type. It has yellow, magenta, cyan, and black image forming stations Pa, Pb, Pc and Pd, respectively, which are aligned in tandem along an intermediary transfer belt 130.

In the image formation station Pa, a yellow toner image is formed on its photosensitive drum 3*a*, and is transferred onto the intermediary transfer belt 130. In the image formation station Pb, a magenta toner image is formed on its photosensitive drum 3*b*, and is transferred onto the intermediary transfer belt 130. In the image formation stations Pc and Pd, cyan and black toner images are formed on their photosensitive drums 3*c* and 3*d*, respectively, and are transferred onto the intermediary transfer belt 130.

After being transferred onto the intermediary transfer belt 130, the four monochromatic toner images, different in color, are conveyed to a secondary transfer station T2, in which they are transferred together (secondary transfer) onto a sheet P of recording medium. Each sheet P of recording medium is pulled out of a recording medium cassette 10 by a pickup roller 7, is separated from the rest of sheets P in the cassette 10 by a pair of separation rollers 6, and is conveyed to a pair of registration rollers 12, which send the sheet P into the secondary transfer station T2 with such a timing that the sheet P arrives at the secondary transfer station T2 at the same time as the arrival of the toner image on the intermediary transfer belt 130.

After the secondary transfer of the four monochromatic toner images, different in color, onto the sheet P of recording medium, the sheet P is separated from the intermediary transfer belt 130 by the curvature of the intermediary transfer belt 130, and is sent into a fixing device 9 (fixing apparatus), which fixes the toner images to the surface of the sheet P by applying heat and pressure to the sheet P and the toner images thereon. Thereafter, the sheet P is discharged from the image forming apparatus 100.

The image forming apparatus 100 can continuously output a preset number of prints at a process speed of 380 mm/sec by repeating the process of feeding a sheet P of paper into the main assembly of the image forming apparatus 100, forming toner images, fixing the toner images, and discharging the sheet P. More specifically, it can output 80 prints of size A4 per minute, in portrait mode.

Next, referring to FIG. 2, a control section 141 monitors and controls each of the various units of the image forming apparatus 100. That is, it makes the image forming apparatus 100 to form images while integrally controlling various operations carried out by the various units of the image forming apparatus 100 by integrally issuing various commands to each unit.

The control panel 142 is an interface through which a user can access the image forming apparatus 100. For example, a user can enter basic settings (recording medium information such as basis weight, image information such density, print count, etc.) into the image forming apparatus 100.

The image forming apparatus 100 is capable of operating in the "mixed job" mode, that is, the mode in which the apparatus 100 continuously outputs prints while switching recording medium in type, size, thickness, and/or the like properties. For example, in the "mixed job" mode, a preset number of booklets consisting of a cover page (material of which is thick sheet of paper), document pages (material of which is thin sheet of paper), and photograph pages (material of which is coated paper), can be continuously outputted. Further, a user can enter the details, such as the temperature setting for the fixing device 9, for a "mixed job" based on recording medium type.

<Image Formation Station>

Referring to FIG. 1, the intermediary transfer belt 130, which makes up a part of the image formation station, is a component onto which a toner image is transferred, and from which the toner image is transferred onto a sheet P of recording medium. The image formation stations Pa, Pb, Pc and Pd are virtually the same in structure, although they are different in the color of the toner they use. Hereafter, therefore, they are going to be described together as image formation stations P, that is, without the suffixes a, b, c and d.

The image forming station P is made up of a photosensitive drum 3, and five drum processing means, more specifically, a charge roller 2, an exposing device 5, a developing device 1, a transfer roller 24, and a drum cleaning device 4, which are arranged in the adjacencies of the peripheral surface of the drum 3 in the listed order. The photosensitive drum 3 is made up of an aluminum cylinder, and a photosensitive layer formed on the peripheral surface of the aluminum cylinder, of semiconductor. It is rotated at a preset process speed in the direction indicated by an arrow mark.

The charge roller 2 negatively and uniformly charges the peripheral surface of the photosensitive drum 3 to a preset potential level of VD (pre-exposure level). The exposing device 5 writes an electrostatic image on the uniformly charged portion of the peripheral surface of the photosensitive drum 3; it scans the uniformly charged portion of the peripheral surface of the photosensitive drum 3 by deflecting, with its rotatable mirror, the beam of laser light it outputs while modulating (turning on or off) the beam with the image formation data which is in the form of sequential electric signals obtained by developing each of multiple monochromatic images obtained by separating the original image. The developing device 1 develops the electrostatic image into a visible image, that is, image formed of toner, by providing the peripheral surface of the photosensitive drum 3 with toner.

The transfer roller 24 forms a transfer station between the photosensitive drum 3 and intermediary transfer belt 130, by pressing the intermediary transfer belt 130 upon the peripheral surface of the photosensitive drum 3. To the transfer roller 24, a preset DC voltage is applied, whereby the toner image on the peripheral surface of the photosensitive drum 3 is transferred onto the intermediary transfer belt 130. The drum cleaning device 4 is provided with a cleaning blade, which is placed in contact with the peripheral surface of the photosensitive drum 3 to rub the peripheral surface of the photosensitive drum 3 in order to recover the transfer residual toner, that is, the toner remaining adhered to the immediately downstream side of the transfer station in terms of the moving direction of the peripheral surface of the photosensitive drum 3.

<Secondary Transfer Station>

Referring to FIG. 1, the intermediary transfer belt 130 is supported by a tension roller 15, a belt backing roller 14, and a belt driving roller 13, spanning between the tension roller 15 and belt backing roller 14, between the belt backing roller 14 and belt driving roller 13, and between the belt driving roller 13 and tension roller 15. It is circularly driven by the driving roller 13 in the direction indicated by an arrow mark R2. The secondary transfer station T2 is formed by placing the secondary transfer roller 11 in contact with the portion of the intermediary transfer belt 130 backed up by the belt backing roller 14; the area of contact between the intermediary transfer belt 130 and secondary transfer roller 14 is the secondary transfer station T2. To the secondary transfer roller 11, a preset DC voltage is applied, whereby the toner image on the intermediary transfer belt 130 is transferred (secondary transfer) onto a sheet P of recording medium while the sheet P is conveyed through the secondary transfer station T2. The belt cleaning device 19 is provided with a piece of cleaning web, which is placed in contact with the outwardly facing surface of the intermediary transfer belt 130 to remove the toner particles, paper dusts, and the like contaminants from the outward surface of the intermediary transfer belt 130.

When the image forming apparatus 100 is in the continuous image formation mode, the control section 141 makes the image forming apparatus 100 carry out a sequence for cleaning the secondary transfer roller 11, during the image intervals (recording medium intervals), and also, at the end of the image forming operation. In the secondary transfer roller cleaning sequence, a preset DC voltage, which is the same in polarity as that of the toner charge, is applied to the secondary transfer roller 11 for a preset length of time, in order to make the stray toner particles having adhered to the secondary transfer roller 11, fog formation toner particles, and the like contaminants return to the intermediary transfer belt 130. That is, this sequence prevents the secondary transfer roller 11 from reducing in transfer performance, and also, prevents the problem that the backside of recording medium is soiled by the aforementioned contaminants.

<Fixing Device>

Figure 3:
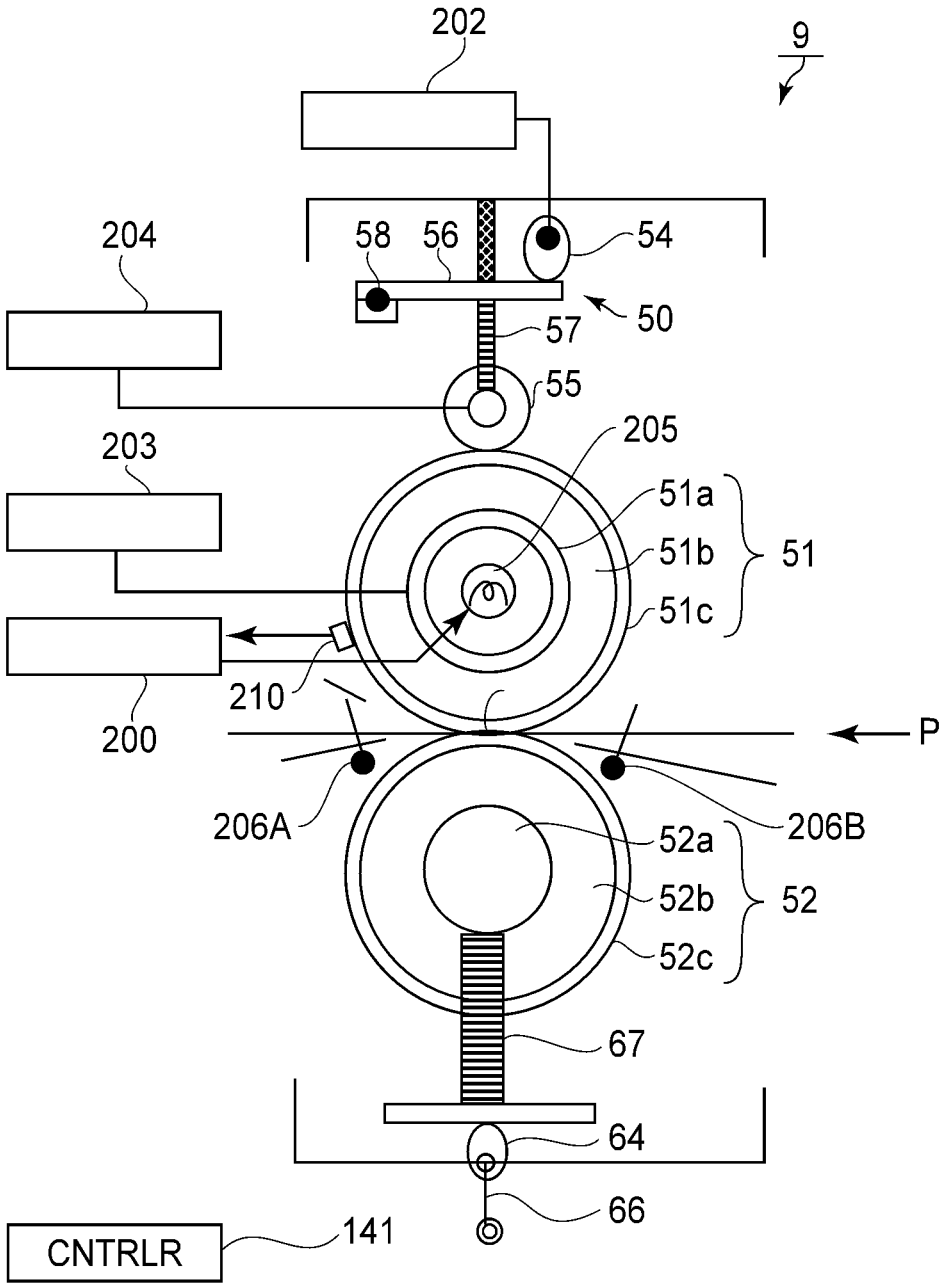
FIG. 3 is a schematic sectional view of a typical fixing device to which the present invention is applicable, at a vertical plane perpendicular to the axial line of the heating member of the fixing device.

FIG. 3 is a schematic sectional view of a typical fixing device to which the present invention is applicable, at a vertical plane perpendicular to the axial line of the heating member of the fixing device. Generally speaking, a fixing device (apparatus), which includes an image heating device (apparatus), has a heating member, which is controlled in temperature, and a pressing member, which is kept pressed upon the heating member to form a heating nip for heating a sheet of recording medium and a toner image thereon. As a sheet of recording medium, which is bearing an unfixed toner image, is conveyed through the heating nip while remaining pinched by the heating member and pressing member, the sheet and the unfixed toner image thereon are subjected to heat and pressure, whereby the unfixed toner image becomes thermally fixed to the sheet. The heating member is a laminar member, having three layers. More specifically, it has a metallic core (as substrate layer), an elastic layer, and a parting layer. The metallic core is made of a metallic substance such as aluminum, stainless steel, or nickel. Generally, the elastic layer is made of silicone rubber. The parting layer is a piece of tube made of fluorinated resin, for example, PFA and PTFE, or a layer formed by coating the peripheral surface of the elastic layer with the same substance as the one of which the piece of tube is made. It covers the outward surface of the elastic layer to make it easier for toner particles to separate from the heating member.

Referring to FIG. 3, the fixation roller 51 is an example of the heating member. It heats the image bearing surface of a sheet P of recording medium, and the toner image thereon. The pressure roller 52 is an example of the pressure applying member. It forms a heating nip N (in which sheet of recording medium is heated) by being pressed upon the peripheral surface of the fixation roller 51.

The fixing device 9 has the fixation roller 51, and the pressure roller 52 which forms the heating nip N by being pressed upon the peripheral surface of the fixation roller 51. It conveys a sheet P of recording medium, on which a toner image is present, through its heating nip N, from its right end to its left end, with reference to FIG. 3, while keeping the temperature of its fixation roller 51 at a preset level, which is higher than the melting point of toner, and also, keeping the sheet P pinched between the fixation roller 51 and pressure roller 52. As the sheet P is conveyed through the fixing device 9, more specifically, the heating nip N between the fixation roller 51, which the image bearing surface of the sheet P faces, and the pressure roller 52, which the opposite surface of the sheet P from the image bearing surface, faces, the sheet P is subjected to heat and pressure. Consequently, the toner image becomes fixed to the surface of the sheet P.

The fixation roller 51 is made up of a metallic core 51*a*, an elastic layer 51*b*, and a parting layer 51*c*. The metallic core 51*a* is cylindrical, and is formed of mild steel. It is 18.5 mm in external diameter. The elastic layer 51*b* covers the peripheral surface of the metallic core 51*a*, and is 0.75 mm in thickness. It is formed of silicone rubber, which is 15° in hardness (under 1 kg of pressure: JIS-A hardness scale A). The parting layer 51*c* is made of a piece of PFA tube, and is 30 μm in thickness. It covers the outward surface of the elastic layer 51*b*. The fixation roller 51 is in the form of a straight hollow cylinder, and is uniform in external diameter. It is 20 mm in external diameter. It is rotatably supported by the lateral plates of the fixing device 9. More concretely, each of the lengthwise ends of the fixation roller 51 is provided with a shaft, which is borne by a bearing with which each lateral plate of the fixing device 9 is provided. The fixation roller 51 is rotationally driven by a fixation roller driving motor 203.

The pressure roller 52 is made up of a metallic core 52*a*, an elastic layer 52*b*, and a parting layer 52*c*. The metallic core 52*a* is cylindrical, and is formed of mild steel. It is 18.5 mm in external diameter. The elastic layer 52*b* covers the peripheral surface of the metallic core 52*a*, and is 0.75 mm in thickness. It is formed of silicone rubber, which is 15° in hardness (under 1 kg of pressure: JIS-A hardness scale A). The parting layer 52*c* is made of a piece of PFA tube, and is 30 μm in thickness. It covers the outward surface of the elastic layer 52*b*. The fixation roller 52 is in the form of a straight hollow cylinder, and is uniform in external diameter. It is 20 mm in external diameter. It is rotatably supported by the lateral plates of the fixing device 9. More concretely, each of the lengthwise ends of the pressure roller 52 is provided with a shaft, which is rotatably supported by an unshown supporting member. The unshown supporting member is kept pressed toward the fixation roller 51 by a total pressure of roughly 500 N generated by a pair of compression springs 67. The pressure roller 52 is rotated in contact with the fixation roller 51, and is rotated by the rotation of the fixation roller 51.

The fixing device 9 is provided with a pressure removal cam 64, and a handle 66 for manually rotating the cam 64. It is structured so that if a sheet of recording medium becomes jammed in the fixing device 9, the jammed sheet can be pulled out of the fixing device 9 in the upstream or downstream direction by manually rotating the cam 64 with the handle 56 to allow the pressure roller 52 to be separated by the springs 67.

The fixing device 9 is provided with a heat lamp (halogen heater) 205, which is in the hollow of the fixation roller 51. Further, the fixing device 9 is provided with a temperature sensor (thermistor) 210, which is on the exit side of the heating nip N, and is kept in contact with the center of the peripheral surface of the fixation roller 51, in terms of the direction parallel to the axial line of the fixation roller 51.

The temperature control section 200 controls the amount by which electric power is supplied to the heat lamp 205, based on the output of the temperature sensor 210, so that the fixation roller 51 remains stable in surface temperature, in terms of the temperature detected by the temperature sensor 210 at a preset target level.

In the case of the fixing device 9 in this embodiment, both the heating member and pressing member, which form the heating nip N, are in the form of a roller. However, the present invention is also applicable to a fixing device, at least one of the heating member and pressing member of which is in the form of a seamless and endless belt.

The fixing device 9 has the heat lamp 205 as its means for heating the fixing member. However, the present invention is also applicable to a fixing device structured so that an exciter coil is positioned inside or outside the fixation roller 51 to heat the metallic portion of the fixation roller 51 by electromagnetic induction.

<Refreshment Roller>

Referring to FIG. 3, the fixing device 9 is provided with a refreshment roller 55, and a mechanism 50 for placing the refreshment roller 55 in contact with the fixation roller 51, or separating the refreshment roller 55 from the fixation roller 51; the fixing device 9 is structured so that the refreshment roller 55 is placed in contact with, or separated from, the fixation roller 51 by a mechanism 50. The refreshment roller 55 is capable of rubbing the peripheral surface of the fixation roller 51 by being placed in contact with the peripheral surface of the fixation roller 51.

When a large sheet of paper is cut into small sheets of paper of a certain size, the edges of each of the resultant small sheets of paper end up with microscopic burrs (paper burrs), which are roughly several micrometers to several tens of micrometers in size. Thus, as a large number of sheets of recording medium which are the same in size are continuously conveyed through the heating nip N of the fixing device 9, the parting layer of the fixation roller 51, which is formed of fluorinated resin, are locally and/or partially roughened by the microscopic burrs which the edges of each sheet has, because the same points of the fixation roller 51, in terms of the direction perpendicular to the recording medium conveyance direction, are continuously pressed by the edge burrs of each of the large number of sheets, while the fixation roller 51 is high in temperature. Thus, the points of the peripheral surface of the fixation roller 51, which coincide with the edges of each sheet of paper, which are parallel to the recording medium conveyance direction, are recessed by several micrometers.

Thus, if a larger (wider) sheet of recording medium (paper) is used for image formation after a substantial number of smaller (narrower) sheets of recording medium are used for image formation, an image forming apparatus outputs a print, which is nonuniform in gloss in that the portions of the print, which correspond in position to the microscopically recessed portions of the fixation roller 51, are different in gloss from the rest, manifesting as unwanted lines. The conspicuousness of this phenomenon is roughly proportional to the size of the edge burr, basis weight of a sheet of recording medium, glossiness of a sheet of recording medium. That is, the larger in size the edge burr of a sheet of recording medium, the more conspicuous the manifestation of the unwanted lines. Further, the usage of the toner with a low melting point, which has been recently developed, seems to exacerbate this phenomenon, because the usage of the toner with a low melting point tends to make an image forming apparatus yield an image higher in gloss.

Thus, the fixing device 9 is provided with a refreshment roller 55, which is one of the outcomes of the technologies for making as inconspicuous as possible, the unwanted lines of an image, which are manifested by their difference in gloss from their adjacencies. The refreshment roller 55 is positioned on the opposite side of the fixation roller 51 from the pressure roller 52.

The refreshment roller 55 is a component for refreshing the peripheral surface of the fixation roller 51. Its peripheral surface is covered with polishing particles adhered to the peripheral surface. More specifically, the refreshment roller 55 is a polishing roller, and is made of a piece of stainless pipe, and polishing particles. The stainless pipe is 12 mm in external diameter. The polishing particles are adhered to the peripheral surface of the stainless pipe. The primary material for the polishing particles is aluminum oxide. The surface roughness Rz of the refreshment roller 55 is in a range of 15-20 μm. If the surface roughness Rz of the refreshment roller 55 is higher than 20 μm, the peripheral surface of the fixation roller 51 is scarred (scratched) too deep, which affects an image forming apparatus in image quality. Therefore, a polishing roller which is higher in surface roughness Rz than 20 μm is undesirable as the refreshment roller 55. Incidentally, the material for the polishing particles may be silicone oxide, titanium oxide, iron oxide, chrome oxide, or the like, or the compound of the preceding substances, instead of aluminum oxide.

The refreshment roller 55 is rotatably supported by its lengthwise ends. The fixing device 9 is also provided with a pair of arms 56, which are pivotally movable about a pivot 58. Further, the fixing device 9 is provided with a pair of compression springs 57, which are positioned between the pair of arms and the lengthwise ends of the refreshment roller 55, one for one. Thus, the refreshment roller 55 can be pressed upon the peripheral surface of the fixation roller 51, or moved away from the peripheral surface of the fixation roller 51, by pivotally moving the arms 56 by rotating the pair of cams 54. The total amount of pressure applied to the refreshment roller 55 by the compression springs 57 when the refreshment roller 55 is kept pressed upon the fixation roller 51 is roughly 10 N.

A motor 204 is for rotating the refreshment roller 55. A motor 202 is for pressing the refreshment roller 55 upon the fixation roller 51, or separating the refreshment roller 55 from the fixation roller 51; it rotates the pressure cams 54 to operate the mechanism 50 for pressing the refreshment roller 55 upon the fixation roller 51 or separated the refreshment roller 55 from the fixation roller 51.

Normally, the control section 141 drives the refreshment roller 55 while keeping the refreshment roller 55 pressed upon the peripheral surface of the fixation roller 51, for every preset number (which is set according to recording medium type of sheets of recording medium, recording medium size, and the ambient condition under which an image forming apparatus is being operated) of sheets of recording medium. More specifically, for every preset number of sheets of recording medium, the control section 141 places the refreshment roller 55 in contact with the peripheral surface of the fixation roller 51 with the application of a preset amount of pressure by controlling the motor 202, and rotates the refreshment roller 55 for a preset length of time, and/or with a preset timing, by controlling the motor 204, so that there is a preset amount of difference (ratio) between the peripheral velocity of the refreshment roller 55 and that of the fixation roller 51. That is, when an image forming apparatus 100 is in an image forming operation, the peripheral surface of the fixation roller 51 is rubbed by the refreshment roller 55 for every preset number of sheets of recording medium. In other words, not only does the control section 141 keep the image forming apparatus stable in print quality, but also, it extends the service life of the refreshment roller 55.

Since the refreshment roller 55 is rotated while being kept pressed upon the peripheral surface of the fixation roller 51 with a preset amount of pressure, with the presence of a preset amount of difference (ratio) in peripheral velocity between the refreshment roller 55 and fixation roller 51, the parting layer 51*c* of the fixation roller 51 is given fine (microscopic) superficial scars, without being shaved away. With the presence of fine (microscopic) scars on the entirety of the peripheral surface of the fixation roller 51, a print which the image forming apparatus 100 outputs will be such that the portions of its toner image, which correspond in position to the linear scars created in the peripheral surface of the fixation roller 51 by the edge burrs of a sheet of recording medium, is less conspicuous. In other words, the refreshment roller 55 changes the fixation roller 51 in surface properties by roughening the surface of the surface layer in order to achieve the above described effect. That is, the refreshment roller 55 uniformly roughens the peripheral surface of the fixation roller 51 by giving fine (microscopic) scars to the peripheral surface of the fixation roller 51, in order to reduces the image forming apparatus in the conspicuousness of the unwanted lines effected across the toner covered areas of a print it outputs, by the difference in glossiness between the portions of the toner covered area, which correspond to the linear scars (recesses) made by the edge burrs of a sheet of recording medium, and the rest of the toner covered area.

In the case of the fixing device 9, in order to properly roughen the peripheral surface of the fixation roller 51, the peripheral velocity of the refreshment roller 55 is set to 760 mm/sec, whereas that of the fixation roller 51 is set to the 380 mm/sec. That is, when the refreshment roller 55 is actually used for refreshing the peripheral surface of the fixation roller 51, its peripheral velocity is 200% of that of the fixation roller 51. From the standpoint of ensuring that the peripheral surface of the fixation roller 51 is properly refreshed, it is desired that the following mathematical equation is satisfied: $7\times10^{-3}\leq(P/\Pi H \tan\theta)\cdot(|V-v|/V\leq68\times10^{-3}$, in which V [mm/sec] stands for the peripheral velocity of the rotational heating component; v [mm/sec], peripheral velocity of the refreshment roller 55; H [Gpa], microhardness of the rotational heating component; and θ [°] stands for half the apex angle of a microscopic protrusion of the peripheral surface of the rotational heating component. With the mathematical equation satisfied, the surface roughness Rz of the rotational heating component is made to fall in a range of 0.5 μm-2.0 μm, by the operation of the refreshment roller 55. Further, microscopic grooves, which are no more than 10 μm in width, are made in the peripheral surface of the fixation roller 51 by the microscopic protrusions of the peripheral surface of the refreshment roller 55, by no less than 10 per 100 μm.

In the case of the fixing device 9, the fixation roller driving motor 203, refreshment roller driving motor 204, and refreshment motor position changing motor 202, are independently controlled (driven) from each other. However, the present invention is also applicable to a fixing device (apparatus) which is different in structure from the fixing device 9. That is, the present invention is also applicable to a fixing device having only the fixation roller driving motor 203. In such a case, the output shaft of the fixation motor driving motor 203 is connected to the pressure application cam and refreshment roller 55 through two separate driving trains, one for one, which are different in terms of the peripheral velocities at which they drive corresponding components. Also in such a case, the mechanism 50 and refreshment roller 55 are controlled through clutches.

<Toner Adhesion Which Occurs as Recording Medium Jams Fixing Device>

If a sheet of recording medium wraps around the fixation roller 51 (if a sheet of recording medium jams the fixing device 9) right before the fixation roller 51 is refreshed in surface properties by the refreshment roller 55, it sometimes occurs that a part of the toner on the sheet of recording medium adheres to the fixation roller 51; when the sheet having jammed the fixing device 9 is removed by a user, or automatically removed by the apparatus, the peripheral surface of the fixation roller 51 is sometimes soiled by the toner on the sheet of recording medium.

In the case of some of the conventionally structured fixing devices (apparatus), the peripheral surface of the fixation roller 51 is changed in properties by the refreshment roller 55 immediately after the unjamming of the fixing device 9. Thus, it sometimes occurred that the toner having transferred onto the fixation roller 51 transfers onto the refreshment roller 55. The transfer of the toner onto the peripheral surface of the refreshment roller 55 reduces the refreshment roller 55 in performance in terms of uniformly roughening of the peripheral surface of the fixation roller 51, which in turn causes the image forming apparatus 100 to output a print of unsatisfactory quality. In other words, in the case of some of the conventionally structured fixing devices, it is possible that the refreshment roller 55 will have to be unexpectedly replaced. In the case of the fixing device 9, which is a fixing device in accordance with the present invention, therefore, in order to prevent the problem that the toner having transferred onto the fixation roller 51 when the fixing device 9 is unjammed, the operational sequence of the refreshment roller 55 is optimized to ensure that the image forming apparatus 100 continues to output high quality prints throughout the service life of the fixing device 9.

Embodiment 1

Figure 4:
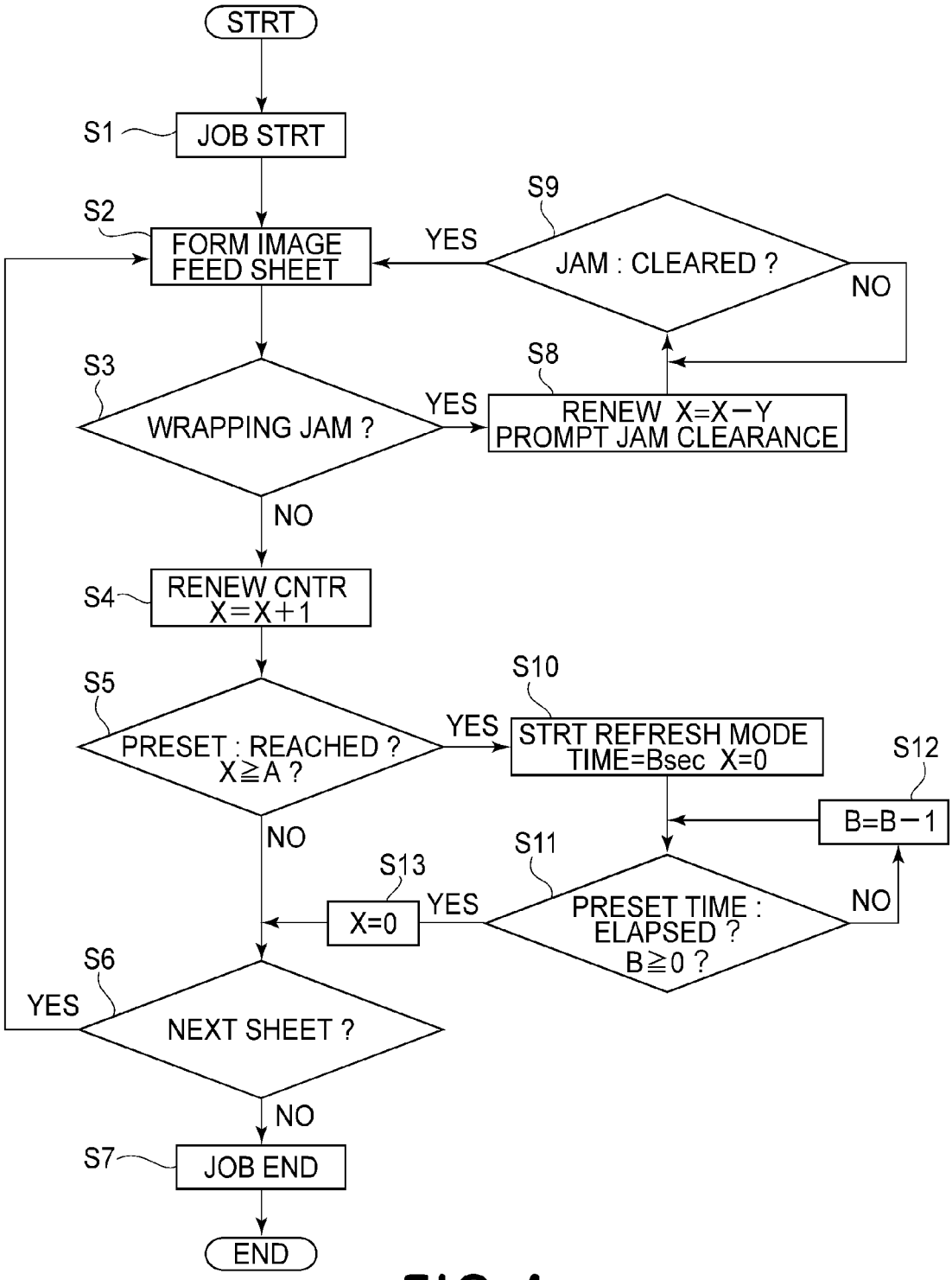
FIG. 4 is a flowchart of the heating member refreshing operation in the first embodiment of the present invention.
Figure 5A:
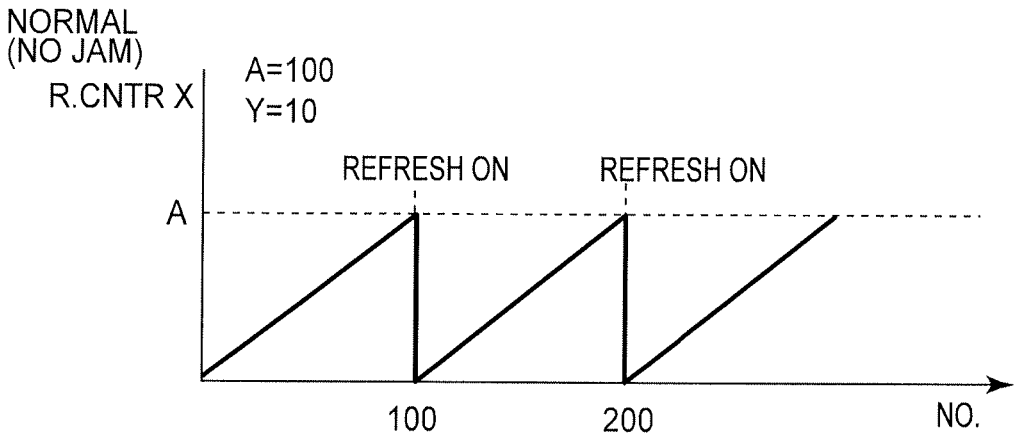
FIGS. 5A and 5B are graphs which show the timings with which the fixing device is operated in the heating member refreshing mode.
Figure 5B:
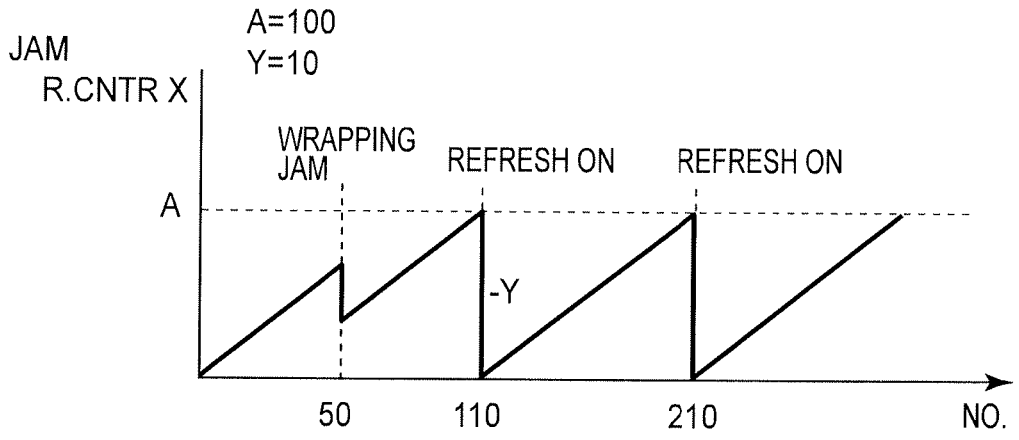

FIG. 4 is a flowchart of the control of the operational sequence for refreshing the fixation roller 51 with the use of the refreshment roller 55. FIGS. 5A and 5B are drawings illustrating the timing with which the fixing device 9 is to be operated in the fixation roller refreshment mode. More specifically, FIG. 5A represents the case in which the fixing device 9 is not jammed, and FIG. 5A represents the case in which the fixing device 9 happens to be jammed.

Referring to FIG. 3, jam detection sensors 206A and 206B, which are examples of jam detecting means, can detect the occurrence of a "fixation jam", that is, the jamming which occurs to the fixing device 9 while a sheet of recording medium is in the heating nip N. The jam detection sensors 206A and 206B are positioned on the downstream and upstream sides, respectively, of the heating nip N in terms of the recording medium conveyance direction. If a sheet of recording medium is detected by the sensor 206A, or the downstream sensor, within a preset length of time after the detection of the sheet by the sensor 206B, or the upstream sensor, it is determined that the sheet is being normally conveyed. If the sheet is not detected by the downstream sensor 206A within a preset length of time after the detection of the sheet by the upstream sensor 206B, it is determined that the "fixation jam" has occurred. That is, the "fixation jam" is the jam that occurs in the heating nip N; a sheet of recording medium wraps around the fixation roller 51. As the occurrence of the fixation jam is detected by the jam detection sensors 206A and 206B, the control section 141 interrupts the on-going image heating operation. Then, as soon as the fixing device 9 is unjammed by a user, the control section 141 restarts the image heating operation. After the restarting of the image heating operation, the control section 141 (prohibiting means) prevents the refreshment roller 55 from rubbing the fixation roller 51 until no less than a preset number of prints (no less than Y) are outputted after the occurrence of the fixation jam, based on the output of the jam detection sensor 206. In terms of the recording medium conveyance direction, the jam detection sensors 206A and 206B are positioned adjacent to the downstream and upstream ends, respectively, of the fixation nip. Incidentally, in this embodiment, whether or not the jamming of the fixing device 9 is a fixation jam is determined with the use of the jam detection sensor 206. If it is determined that the jamming of the fixing device 9 is the fixation jam, the control section 141 separates the refreshment roller 55 from the fixation roller 51, preventing thereby the refreshment roller 55 from rubbing the fixation roller 51. If it is determined that the jamming of the fixing device 9 is a jam other than the fixation jam, the control section 141 does not delay, or prevent, the rubbing of the fixation roller 51 by the refreshment roller 55; it allows the refreshment roller 55 to rub the fixation roller 51 with a preset timing. "Jams other than fixation jam" means a jam that occurs before a sheet of recording medium reaches the heating nip N, and also, a jam that occurs when a sheet of recording medium is at the pair of registration rollers 12. In this embodiment, the control section 141 controls the sequence for interrupting the image heating operation as the fixing device 9 is jammed, sequence for restarting the heating operation after the unjamming of the fixing device 9, and sequence for rubbing the peripheral surface of the fixation roller 51 with the refreshment roller 55. That is, the controller (first controller) which controls the sequence for interrupting the image heating operation as the fixing device 9 is jammed, and sequence for restarting the image heating operation after the unjamming of the fixing device 9, is the same as the controller (second controller) which controls the operational sequence for rubbing the fixation roller 51 with the refreshment roller 55. Needless to say, this embodiment is not intended to limit the present invention in terms of the structure of the fixing device 9. That is, the present invention is also applicable to a fixing device structured so that the first and second controllers are two separate controllers.

Until a fixation jam occurs, the control section 141 places the refreshment roller 55 in contact with the fixation roller 51 with a preset timing to make the refreshment roller 55 microscopically abrade the peripheral surface of the fixation roller 51. If the number of images formed by the image forming apparatus 100 between the occurrence of the fixation jam and a preset timing for the rubbing of the fixation roller 51 by the refreshment roller 55 is no more than a preset count Y (value), the control section 141 makes the refreshment roller 55 rub the fixation roller 51 after no less than the preset number (Y) of images (prints) are formed.

The image (print) formation counter (refreshment interval counter) is reset each time the fixation roller 51 is rubbed by the refreshment roller 55. Then, as the count (value) in the counter reaches a preset value A, the fixation roller 51 is rubbed again by the refreshment roller 55. Each time the fixation jam occurs, the preset value Y is subtracted from the count (value) X in the refreshment interval counter.

Referring to FIG. 4 along with FIG. 2, as a print job is started (S1), the control section 141 repeats the combination of the image forming operation and recording medium conveying operation (S2-S6). As an image forming operation normally ends in its entirety (N in S6), the control section 141 ends the image formation job (S7). Normally, the refreshment roller 55 is kept on standby; it is kept separated from the fixation roller 51.

In a case where the occurrence of the fixation jam is not detected by the jam detection sensor 206 during the image formation job (Y in S3), the control section 141 carries out the continuous sheet conveyance operation (S4-S6), and also, carries out the refreshment operation with preset intervals (S10-S12). As the cumulative image formation counts reaches a count (value) A (one is equivalent to conveyance of single sheet of recording medium of size A4 in the portrait mode (small sheet of recording medium; no more than 216 mm in length), the control section 141 makes the fixing device 9 operate in the refreshment mode. A value of two is added to the counter per sheet of size A4, whereas a value of three is added to the counter per extended sheet of size A4. That is, the counter value (sheet count) at which the refreshment operation is carried out is set (determined) according to the recording medium size. Further, the sheet count at which the refreshment operation is to be carried out may be set according to the condition under which the fixing device 9 (image heating device) is used, and/or recording medium type. That is, the fixing device 9 may be structured so that a value added to the count (value) in the counter when a sheet of thick paper is conveyed is greater than that when a sheet of thin paper is conveyed.

Each time a sheet P of recording medium is normally conveyed through the fixing device 9, the control section 141 adds one to the count (value) X (X=X+1) in the refreshment counter (S4). Then, as the count (value) in the refreshment counter reaches the preset value A (Y in S5), the control section 141 activates the refreshment roller 55 to refresh the fixation roller 51 (S10).

When the fixing device 9 is in the refreshment mode, the peripheral velocity of the fixation roller 51 is kept at 380 mm/sec, which is the same as that when the fixing device 9 is in the normal fixation mode. In the refreshment mode, the refreshment roller 55 is pressed on the peripheral surface of the fixation roller 51 by the refreshment roller moving motor 202, while being rotated at a peripheral velocity of 760 mm/sec by the refreshment motor driving motor 204. In the refreshment operation, the peripheral surface of the fixation roller 51 is made uniform in roughness (0.5-0.6 Rz) to reduce the fixing device 9 in the level of nonuniformity in glossiness, which is attributable to the scratches left in the peripheral surface of the fixation roller 51 by the edge burrs of a sheet of recording paper, and at which an image (print) is outputted from the fixing device 9.

The control section 141 counts down starting from a preset value B (in seconds) (S12). As a length of time equal to the value B elapses (Y in S11), the control section 141 ends the refreshment operation by carrying out in reverse the refreshment operation sequence, and prepares the fixing device 9 for the conveyance of the next sheet of recording medium (S6).

Referring to FIG. 5A, when the fixing device 9 is normally operating, that is, when the fixation jam does not occur, the count (value) in the refreshment counter is increased by a preset value per sheet of recording medium. Then, as the cumulative number (value in the refreshment counter) of image formation reaches 100, the refreshment operation is carried out (S10-S12). As the fixing device 9 is operated in the refreshment mode (Y in S11), the refreshment counter is reset to zero (S13). In the first embodiment, the count (value) A for refreshment sequence initiation in terms of the cumulative number of sheets of recording medium is 100 (A=100), and the value B for the length of refreshment operation is 10 seconds (B=10).

By the way, it sometimes occurs that the occurrence of the fixation jam is detected by the jam detection sensor 206 while an image formation job is carried out (Y in S3). Referring to FIG. 3, the jam detection sensor 206, which is for detecting the occurrence of the wrapping of a sheet of recording medium around the fixation roller 51, is located in the recording medium passage, right next to the downstream end of the heating nip N of the fixing device 9.

The control section 141 determines the location of a sheet P of recording medium by monitoring the signals (ON or OFF) from the jam detection sensor 206. If the leading edge of the sheet P does not reach the jam detection sensor 206A within a preset length of time after it is detected by the jam detection sensor 206B, the control section 141 determines that the fixation jam has occurred. Then, it stops the recording medium conveyance, and also, stops heating the fixation roller 51.

Then, the control section 141 informs a user of the occurrence of the fixation jam through the control panel 142, and prompts the user to remove the sheet of recording medium in the jammed fixing device 9. That is, the control section 141 displays a message on the control panel 142 to prompt the user to deal with the jam.

Then, the control section 141 reduces the count (value) X in the refreshment counter by a preset value Y (X=X−Y) (S8). This step is a precautionary step for the possibility that the unfixed toner on a sheet P of recording medium will have adhered to the fixation roller 51 when the jam was dealt with (S9). In other words, this step is for preventing the fixing device 9 from being operated in the refreshment mode immediately after the completion of the process of dealing with the jam (Y in S9). If the fixing device 9 is operated in the refreshment mode right after the completion of the process of dealing with the jam, the contaminative toner having adhered to the fixation roller 51 transfers onto the refreshment roller 55, and is likely to fill the microscopic recesses in the peripheral surface of the refreshment roller 55, which possibly permanently makes it impossible for the refreshment roller 55 to microscopically scratch the peripheral surface of the fixation roller 51.

In this embodiment, therefore, in order to prevent the fixing device 9 from being operated in the refreshment mode immediately after the occurrence of the fixation jam, the following operational sequence is carried out. That is, in a case where the count (value) X in the refreshment counter reaches a value A before the number of sheets of recording medium having moved through the heating nip N reaches the preset value (10), the operation for rubbing the peripheral surface of the fixation roller 51 is delayed.

Next, referring to FIG. 5B, in a case where the fixation jam occurred during an image formation job, the count (value) in the refreshment counter is reduced by 10 per occurrence. Therefore, the interval with which the fixing device 9 is operated in the refreshment mode is equivalent to (100+10× N) sheets, in which N stands for the number of the fixation jam occurrences. In this embodiment, the value Y by which the count (value) in the refreshment counter is reduced each time the fixation jam occurs is 10 (Y=10).

In order to test the fixing device 9 (image forming apparatus 100), the fixing device 9 was intentionally jammed for every 1,000th sheet of recording medium throughout the service life of the fixing device 9 (equivalent to 300,000 small sheets) while making the fixing device 9 operate in the refreshment mode based on the count (value) in the refreshment counter in the first embodiment. The test proved that the primary object of the present invention, that is, to uniformly and microscopically roughen the peripheral surface of the of the fixation roller 51 in order to prevent the fixing device 9 (image forming apparatus 100) from outputting a print which suffers from the nonuniformity in gloss attributable to the microscopic grooves created in the peripheral surface of the fixation roller 51 by the edge burrs of a sheet of recording medium (paper) was met. Further, the amount by which the toner adheres to the fixation roller 51 after the occurrence of the fixation jam was very small. Therefore, even though the toner having transferred onto the fixation roller 51 adhered to a sheet of recording medium, it had virtually no effect upon the image quality level at which a print (image) is outputted by the image forming apparatus 100. That is, the refreshment operation control in the first embodiment prevented the problem that the refreshment roller 55 is soiled by the contaminative toner immediately after the occurrence of the fixation jam. Thus, it ensures that the fixing device outputs satisfactory images, that is, images which do not suffer from the defects attributable to the microscopic scars created in the peripheral surface of the fixation roller 51 by the edge burrs of a sheet of recording medium, throughout its service life.

Embodiment 2

Figure 6:
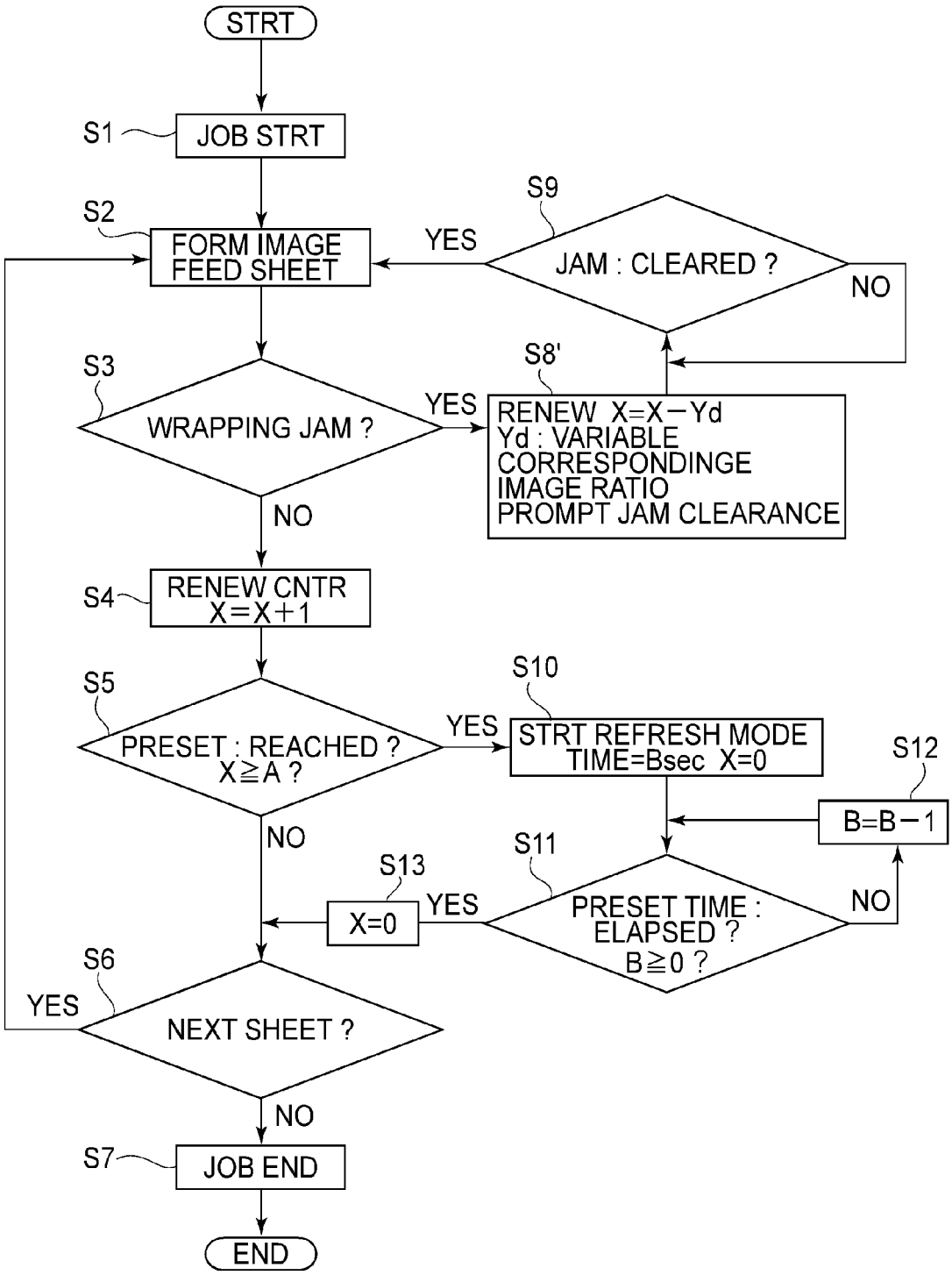
FIG. 6 is a flowchart of the heating member refreshing operation in the second embodiment of the present invention.
Figure 7A:
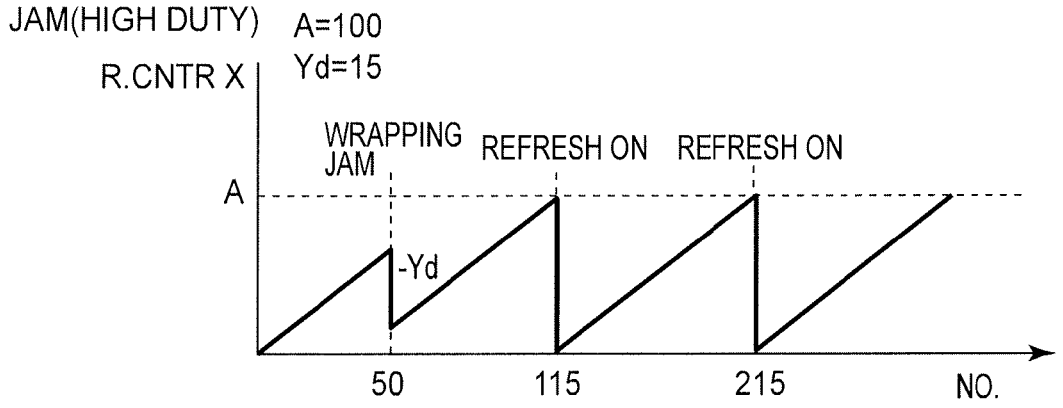
FIGS. 7A and 7B are graphs which show the timings with which the fixing device is operated in the heating member refreshing mode.
Figure 7B:
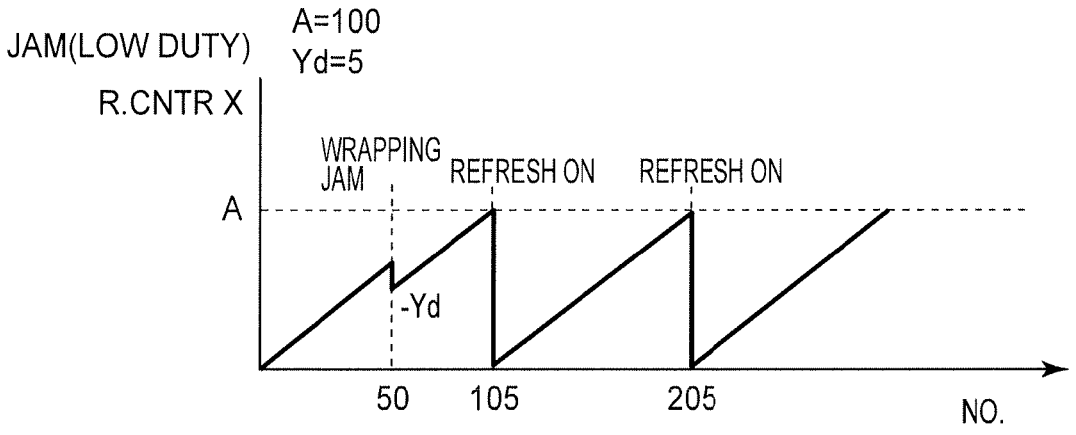

FIG. 6 is a flowchart of the fixation roller refreshment control in the second embodiment of the present invention. FIGS. 7A and 7B are drawings illustrating the timing with which the fixing device 9 is to be operated in the fixation roller refreshment mode. More specifically, FIG. 7A represents the case in which the fixing device 9 is jammed during an image forming operation which is relatively high in image ratio, and FIG. 7B represents the case in which the fixing device 9 is jammed during an image forming operation which is relatively low in image ratio.

In the first embodiment, the value Y by which the value in the refreshment counter was reduced each time the fixation jam occurred was fixed; it was 10. In the second embodiment, it was made variable; it was varied according to the amount of the toner which was on the sheet of recording medium which caused the fixation jam. The difference between the flowchart in FIG. 4 and that in FIG. 6 is the difference between the steps S8 and S8' in FIGS. 4 and 6, respectively. Otherwise, the refreshment operation sequence in the second embodiment is the same as that in the first embodiment. Therefore, the steps in FIG. 6, which are the same as the counterparts in FIG. 4 are given the same referential codes as those given to the counterparts, and are not going to be described here.

In this embodiment, in a case where the jam occurs immediately after the completion of the refreshment sequence, the count (value) X in the refreshment counter is not reduced. That is, the timing with which the value X in the counter reaches the preset value A will be after the number by which sheets of recording medium are conveyed after the unjamming of the fixing device 9 reaches a preset value (15). In such a case the counter is not reduced in the value X therein; the value X is left in the counter. On the other hand, in a case where the occurrence of the jam is not immediately after the completion of the fixation roller refreshment sequence, the counter is reduced in the count (value) X therein. That is, in a case where the timing with which the value X in the counter reaches the preset value A will be before the number by which sheets of recording medium are conveyed after the unjamming of the fixing device 9 reaches a preset value (15). In such a case, the count (value) X in the refreshment counter is reduced to delay the timing with which the fixation roller 51 is rubbed by the refreshment roller 55.

Referring to FIG. 3, moreover, in this embodiment, the control section 141, which functions as an estimating means, is enabled to estimate the amount by which toner is consumed per image formation. Thus, the control section 141 increases the preset value (Yd) in proportion to the amount of the toner on the sheet of recording medium which caused the interruption of the recording medium conveyance, based on the estimated amount of the toner consumption.

The refreshment counter is reset each time the fixation roller 51 is rubbed by the refreshment roller 55. As the count (value) X in the counter, which is increased each time a preset number of images are formed, reaches the preset value A, the fixation roller 51 is rubbed again by the refreshment roller 55. The value Yd which is subtracted from the count X each time the fixation jam occurs is proportional to the amount (estimated) of the toner on the sheet of recording medium which caused the fixation jam.

Referring to FIG. 6 along with FIG. 2, as the occurrence of the fixation jam is detected by the jam detection sensor 206 while an image formation job is carried out (Y in S3), the control section 141 stops the recording medium conveyance and the heating of the fixation roller 51. Then, the control section 141 informs a user of the occurrence of the fixation jam through the control panel 142, and prompts the user to remove the sheet of recording medium in the jammed fixing device 9 (S8').

The control section 141 sets the count (value) Yd by which the count (value) X in the refreshment counter is to be reduced, to a value which is proportional to the image ratio of the print which caused the jam. "Image ratio" means the cumulative value of the image formation signals, which is calculated by the control section 141 during an image forming operation. It is proportional to the amount of toner consumption per print (sheet of recording medium). Here, the image ratio is a value obtained by adding image ratios of the yellow, magenta, cyan, and black monochromatic toner images. Its maximum value is 200%.

The higher the image ratio, the more likely it is for the fixation roller 51 to be soiled by toner during the unjamming of the fixing device 9, and therefore, the greater the number of the sheets of recording medium which have to be conveyed to remove the contaminative toner from the fixation roller 51. In the second embodiment, therefore, the count in the refreshment counter is reduced in proportion to the image ratio of the print (sheet of recording medium) which caused the fixation jam; the higher the image ratio, the greater the value by which the count in the refreshment counter is reduced.

"Image ratio" is calculated for each print (sheet of recording medium) to obtain the amount by which each of the toners, different in color, is consumed to form the image for the print, in order to replenish each developing device with toner by the amount by which toner was consumed therefrom. Thus, it is reflected upon the amount by which each developing device is replenished with toner. The control section 141 presumes that the greater the total amount by which toner was consumed for image formation per sheet of recording medium conveyed to the fixing device 9, the greater the amount by which toner adheres to the fixation roller 51. Thus, it increases the value of the count (value) Yd by which the count in the refreshment counter is to be reduced, in proportion to the total amount of toner consumption per print.

In the second embodiment, when image ratio is no less than 30%, Yd is set to 15 (Yd=15). When image ratio is no less than 5% and no more than 30%, Yd is set to 5 (Yd=5). Further, when image ratio is no more than 5%, Yd is set to 0 (Yd=0). Controlling the fixation roller refreshing operation as described above can minimize the amount by which the refreshment roller 55 is soiled by the contaminative toner from the fixation roller 51, and therefore, can keep the refreshment roller 55 at the highest level in performance in terms of microscopically scratching the peripheral surface of the fixation roller 51. Thus, the second embodiment is superior to the first embodiment in terms of the prevention of the formation of a print (image) which suffers from the nonuniformity in gloss (fine linear pattern effected by nonuniformity in gloss attributable to microscopic grooves made in the surface of the fixation roller 51 by the edge burrs of a sheet of recording medium (paper)), and also, in terms of the length of the service life of the fixing device 9.

Referring to FIG. 7A, in a case where the fixation jam is caused by a high duty print (sheet of recording medium), that is, a print which is no less than 30% in image ratio, the count (value) in the refreshment counter is reduced by 15 per fixation jam. Thus, the interval, in terms of sheet count, with which the fixing device 9 is operated in the refreshment mode extends from the normal one (100) to 115 (=100+15).

Next, referring to FIG. 7B, in a case where the fixation jam is caused by a medium duty print (sheet of recording medium), that is, a print which is no less than 5%, and no more than 30%, in image ratio, the count (value) in the refreshment count is reduced by 5 per fixation jam. Thus, the interval, in terms of sheet count, with which the fixing device 9 is operated in the refreshment mode, extends from the normal one (100) to 105 (=100+5). Further, if the fixation jam is caused by a low duty print (sheet of recording medium), that is, a print which is no more than 5% in image ratio, the count (value) in the refreshment count is not reduced at all, because the print has only a very small amount of toner which possibly adheres to the fixation roller 51. That is, the operation for rubbing the peripheral surface of the fixation roller 51 with the refreshment roller 55 is carried out without any delay.

According to the fixation roller refreshment control in the second embodiment, the interval with which the fixation refreshment operation is carried out is controlled with the use of the refreshment counter, and the count (value) in the counter is reduced according to the image ratio of the print which caused the fixation jam. Therefore, it is ensured that the amount by which contaminative toner adheres to the refreshment roller 55 is minimized. Therefore, the second embodiment was superior to the first embodiment in terms of the effectiveness with which the peripheral surface of the fixation roller 51 is microscopically and uniformly roughened by the refreshment roller 55, and also, preventing the fixing device 9 (image forming apparatus 100) from outputting a print (image) which suffers from the nonuniformity in gloss attributable to the microscopic grooves made in the peripheral surface of the fixation roller 51 by the edge burrs of a sheet of recording medium.

Embodiment 3

In the first and second embodiments, the fixing device was of the roller type. That is, both the heating member and pressing member of the fixing device were in the form of a roller. In comparison, in the third embodiment, the fixing device is of the belt type. That is, one or both of the heating member and pressing member are in the form of an endless belt, which is backed up by a roller positioned on the inward side of the loop which the belt forms. Thus, the fixation nip is formed between the pair of endless belts, or between one of the endless belts and a pressure roller.

Also in the first and second embodiment, the image forming apparatus was a color printer which is not only of the tandem type, but also, of the intermediary transfer type. That is, the apparatus had multiple image formation stations, and an intermediary transfer member along which the multiple image formation stations are aligned. However, the first and second embodiment are not intended to limit the present invention in terms of image forming apparatus type. That is, the present invention is also applicable to a color printer which has only a single drum and an intermediary transfer member, and which sequentially forms multiple monochromatic toner images, different in color, on the single drum, and sequentially transfers the multiple monochromatic toner images onto the intermediary transferring member, and a color printer of the direct transfer type, which has multiple image formation stations, but does not have an intermediary transferring member, and which directly transfers multiple monochromatic toner images, different in color, onto a sheet of recording medium. Further, the present invention is applicable to image forming apparatuses other than a printer. For example, the present invention is applicable to a copying machine, a facsimile machine, and the like.

Moreover, the present invention is also applicable to a fixing device (apparatus) structured so that its refreshment roller is prevented from rubbing its fixation roller not only when the fixation jam occurred, but also, when the fixing device is jammed in the location other than the fixation nip.

Further, the present invention is applicable to a fixing device (apparatus) structured so that the timing for the fixation roller refreshment operation is set based on the length of time the fixing device is being operated, instead of the print count (sheet count).

While the invention has been described with reference to the structures disclosed herein, it is not confined to the details set forth, and this application is intended to cover such modifications or changes as may come within the purposes of the improvements or the scope of the following claims.

What is claimed is:

1. An image heating apparatus comprising:

first and second rotatable members configured to form a nip portion therebetween for heating a toner image on a recording material in an image heating operation;

a rubbing rotatable member configured to rub an outer surface of said first rotatable member;

a moving mechanism configured to move said rubbing rotatable member between a contacted position in which said rubbing rotatable member is contacted to said first rotatable member and a spaced position in which said rubbing rotatable member is spaced from said first rotatable member;

a jam controller configured to (i) interrupt the image heating operation with an occurrence of a jam in the nip portion and (ii) restart the image heating operation after the jam is cleared; and a rubbing controller configured to execute a rubbing operation with a movement of said rubbing rotatable member from the spaced position to the contacted position by said moving mechanism when a predetermined number of recording materials each having a predetermined width is passed through the nip portion without the occurrence of the jam after last rubbing operation is executed, wherein when the jam occurs after the last rubbing operation is executed, said rubbing controller prohibits the execution of the rubbing operation until a predetermined number of recording materials is passed through the nip portion after the jam is cleared.

2. An apparatus according to claim 1, wherein the predetermined number of the recording materials is smaller than the predetermined number of recording materials each having the predetermined width.

3. An apparatus according to claim 1, wherein said rubbing rotatable member rubs said first rotatable member in the rubbing operation so that a surface roughness Rz of said first rotatable member is not less than 0.5 μm and not more than 2.0 μm.

4. An apparatus according to claim 1, wherein said rubbing rotatable member rubs said first rotatable member in the rubbing operation so that recesses whose widths are not more than 10 μm are formed on the surface of said first rotatable member at a density of 10 or more recesses per 100 μm measured in a longitudinal direction of said first rotatable member.

5. An apparatus according to claim 1, wherein said rubbing controller makes said rubbing rotatable member move to the spaced position from the contacted position by said moving mechanism when the rubbing operation is finished.

6. An apparatus according to claim 1, wherein said rubbing rotatable member is a roller having polishing particles thereon.

7. An apparatus according to claim 1, wherein the recording materials each having the predetermined width are recording materials each having a width narrower than a maximum width of the recording material usable in said apparatus.

* * * * *